US012376643B2

(12) United States Patent
Andreasen et al.

(10) Patent No.: US 12,376,643 B2
(45) Date of Patent: Aug. 5, 2025

(54) FOOTWEAR HEEL RETENTION DEVICE

(71) Applicant: NIKE, Inc., Beaverton, OR (US)

(72) Inventors: Lindsey K. Andreasen, Beaverton, OR (US); Evan Perkins, Portland, OR (US); Juliana Sagat, Beaverton, OR (US)

(73) Assignee: NIKE, Inc.

( * ) Notice: Subject to any disclaimer, the term of this patent is extended or adjusted under 35 U.S.C. 154(b) by 171 days.

(21) Appl. No.: 17/959,764

(22) Filed: Oct. 4, 2022

(65) Prior Publication Data

US 2023/0107425 A1 Apr. 6, 2023

Related U.S. Application Data

(60) Provisional application No. 63/252,922, filed on Oct. 6, 2021.

(51) Int. Cl.

| | |
|---|---|
| ***A43B 11/00*** | (2006.01) |
| ***A43B 3/24*** | (2006.01) |
| ***A43B 13/28*** | (2006.01) |
| ***A43B 21/28*** | (2006.01) |
| ***A43B 21/32*** | (2006.01) |

(52) U.S. Cl.

CPC ..... *A43B 11/00* (2013.01); *A43B 13/28* (2013.01); *A43B 21/28* (2013.01); *A43B 3/242* (2013.01); *A43B 21/32* (2013.01)

(58) Field of Classification Search

CPC ..... A43B 13/41; A43B 23/08; A43B 3/0036; A43B 13/181; A43B 3/0063; A43B 21/28; A43B 23/088; A43B 11/02; A43B 11/00; A43B 13/188; A43B 13/189; A43B 13/206; A43B 21/265; A43C 11/008

USPC ..... 36/69, 92, 89

See application file for complete search history.

(56) References Cited

U.S. PATENT DOCUMENTS

| | | | | |
|---|---|---|---|---|
| 11,464,287 | B2 * | 10/2022 | Kilgore | A43B 21/24 |
| 2012/0192461 | A1 * | 8/2012 | Backus | A43C 19/00 24/3.12 |
| 2018/0110292 | A1 * | 4/2018 | Beers | A43B 13/28 |
| 2020/0229536 | A1 | 7/2020 | Hopkins et al. | |
| 2021/0106094 | A1 * | 4/2021 | Cheney | A43B 3/0031 |

OTHER PUBLICATIONS

European Patent Office (ISA), International Search Report and Written Opinion for Application No. PCT/US2022/045768, mailed Jan. 18, 2023.

* cited by examiner

*Primary Examiner* — Alissa L Hoey
*Assistant Examiner* — Akwokwo Olabisi Redhead
(74) *Attorney, Agent, or Firm* — Honigman LLP; Matthew H. Szalach; Jonathan P. O'Brien

(57) ABSTRACT

An article of footwear including a sole structure, an upper attached to the sole structure and including an opening providing access to an interior void of the upper, a support attached to the upper at a posterior end of the upper and including a first rail disposed adjacent to the opening of the upper and a second rail extending between the first rail and the sole structure and continuously along the posterior end from a medial side of the upper to a lateral side of the upper, and a bladder disposed between the first rail and the second rail.

18 Claims, 8 Drawing Sheets

FOOTWEAR HEEL RETENTION DEVICE

CROSS REFERENCE TO RELATED APPLICATION

This application claims priority under 35 U.S.C. § 119 (e) to U.S. Provisional Application No. 63/252,922, filed on Oct. 6, 2021. The disclosure of this prior application is considered part of the disclosure of this application and is hereby incorporated by reference in its entirety.

FIELD

The present disclosure relates generally to a heel construction for an article of footwear.

BACKGROUND

This section provides background information related to the present disclosure and is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. For example, a sole structure may include a midsole and an outsole. The midsole is generally disposed between the outsole and the upper and provides cushioning for the foot. The outsole provides abrasion-resistance and traction with the ground surface and may be formed from rubber or other materials that impart durability and wear-resistance, as well as enhance traction with the ground surface.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1:
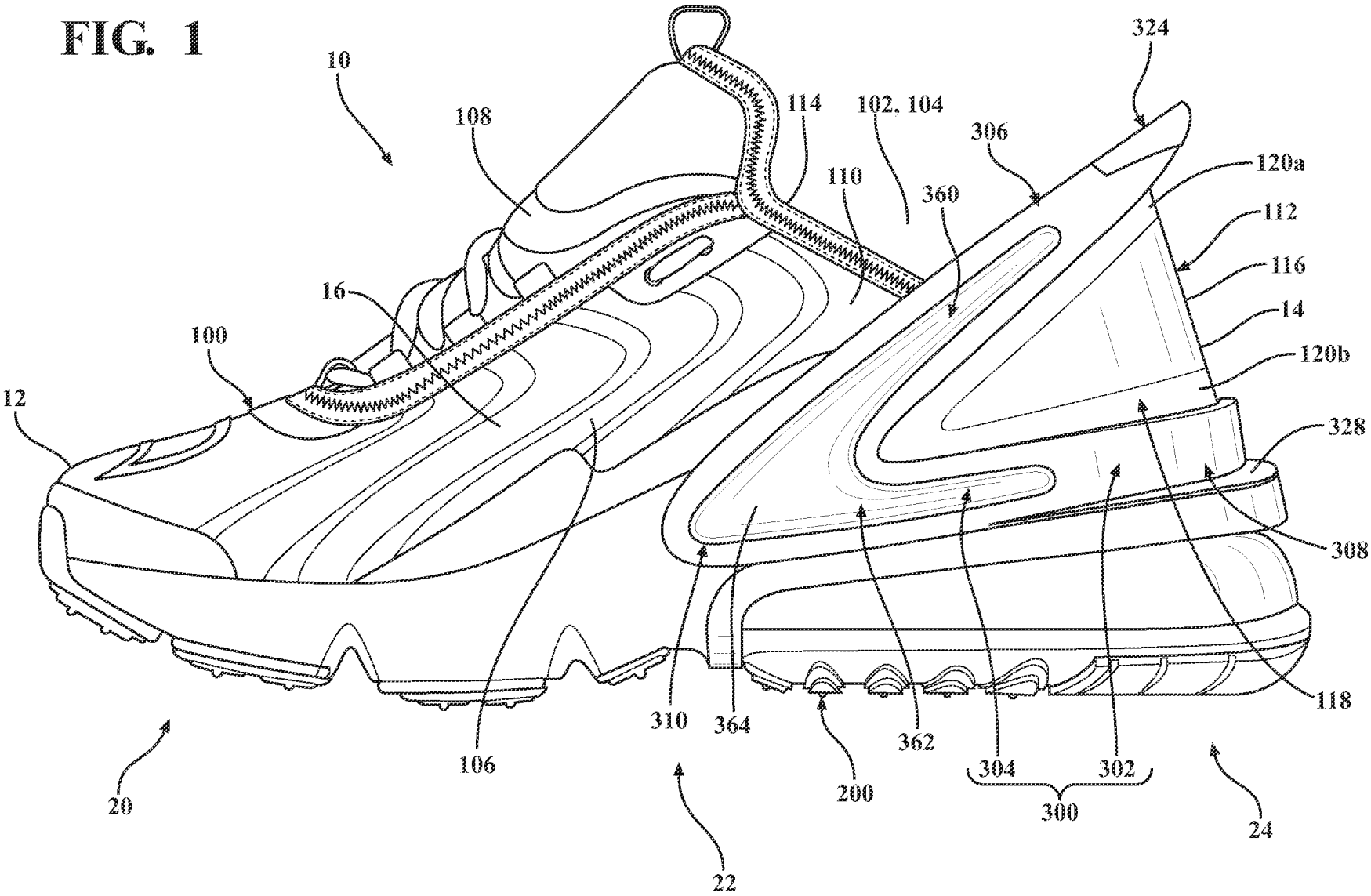
FIG. 1 is a medial side view of an article of footwear including an example of a heel retention device according to the present disclosure.
Figure 2:
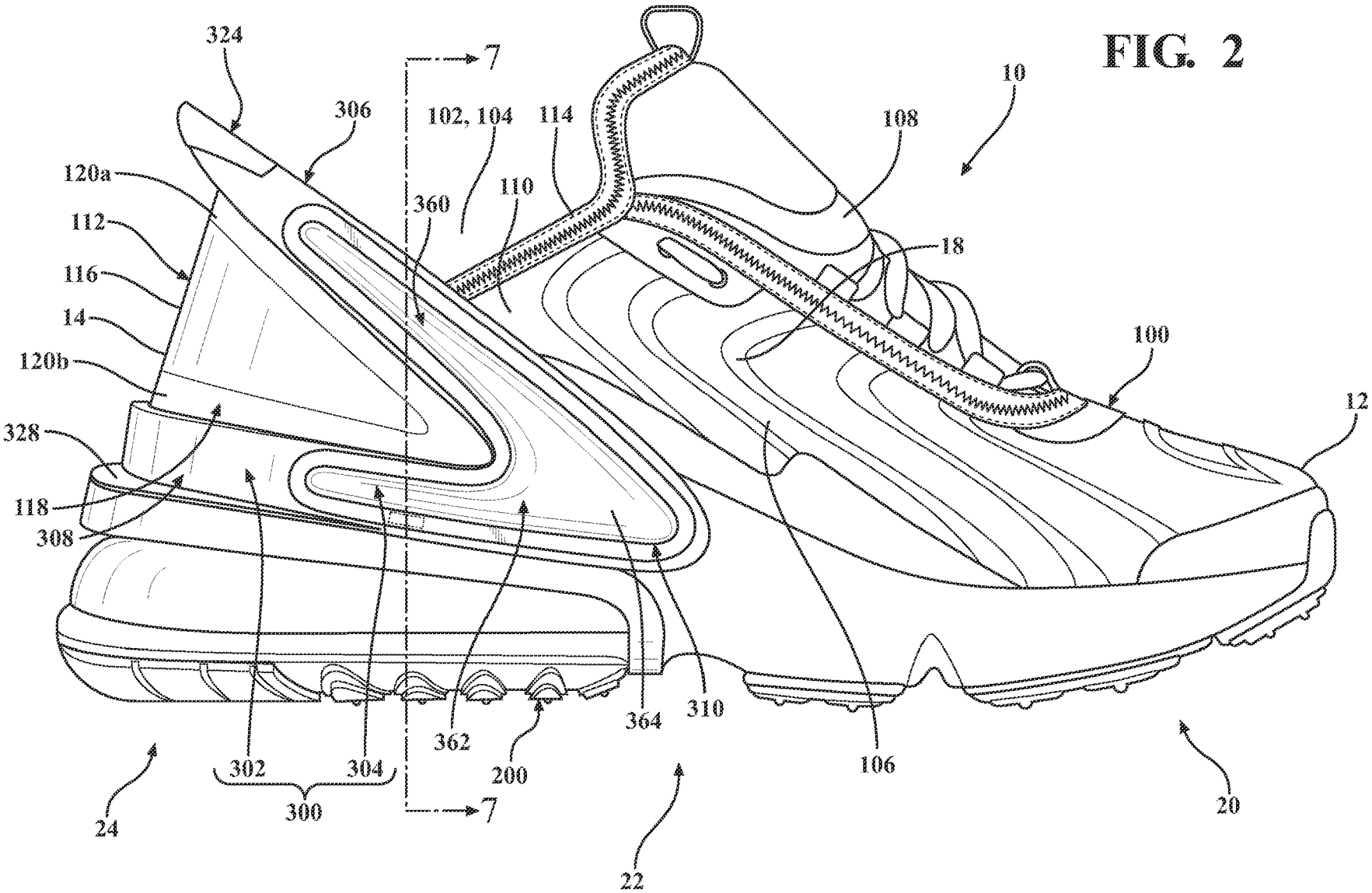
FIG. 2 is a lateral side view of the article of footwear of FIG. 1.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

The details of one or more implementations of the disclosure are set forth in the accompanying drawings and the description below. Other aspects, features, and advantages will be apparent from the description, the drawings, and the claims.

Figure 3:
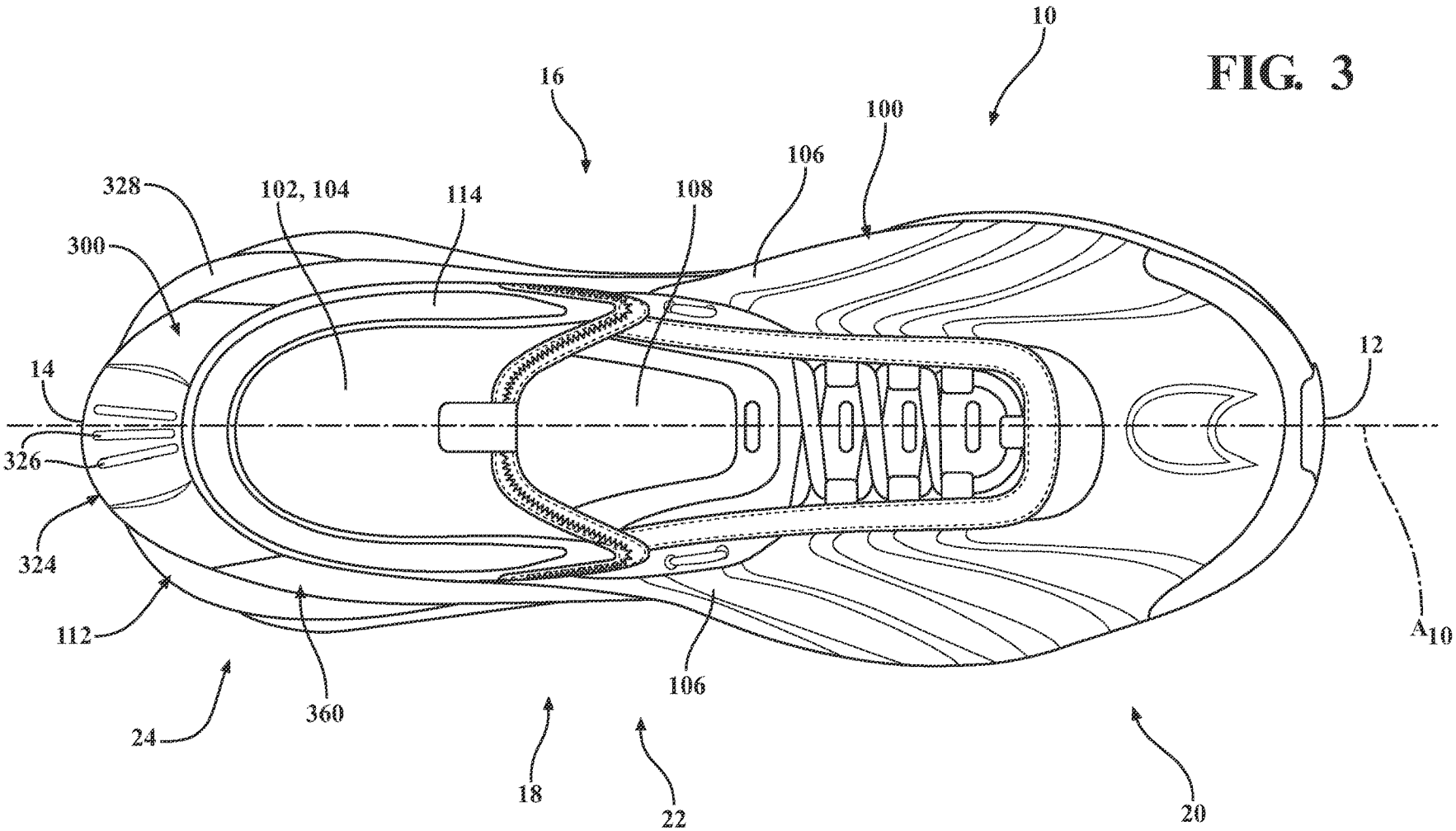
FIG. 3 is a top plan view of the article of footwear of FIG. 1.

Referring to FIG. 1, an article of footwear 10 includes an upper 100, a sole structure 200 attached to the upper 100, and a support 300 connected to the upper 100 and the sole structure 200 and operable to bias the upper 100 towards an erect or upright state. The footwear 10 may further include an anterior end 12 associated with a forward-most point of the footwear 10, and a posterior end 14 corresponding to a rearward-most point of the footwear 10. As shown in FIG. 3, a longitudinal axis A10 of the footwear 10 extends along a length of the footwear 10 from the anterior end 12 to the posterior end 14 parallel to a ground surface, and generally divides the footwear 10 into a medial side 16 and a lateral side 18. Accordingly, the medial side 16 and the lateral side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18.

The article of footwear 10 may be divided into one or more regions. The regions may include a forefoot region 20, a mid-foot region 22, and a heel region 24. The forefoot region 20 may correspond with phalanges and a metatarsophalangeal (MTP) joint of the foot. The mid-foot region 22 may correspond with an arch area of the foot, and the heel region 24 may correspond with rear portions of the foot, including a calcaneus bone.

The upper 100 forms an enclosure having a plurality of components that cooperate to define an interior void 102 and an ankle opening 104, which cooperate to receive and secure a foot for support on the sole structure 200. For example, the upper 100 includes a pair of quarter panels 106 in the mid-foot region 22 on opposite sides of the interior void 102. A throat 108 extends across the top of the upper 100 and defines an instep region extending between the quarter panels 106 from the ankle opening 104 to the forefoot region 20. In the illustrated example, the throat 108 is enclosed, whereby a material panel extends between the opposing quarter panels in the instep region to cover the interior void 102. Here, the material panel covering the throat 108 may be formed of a material having a higher modulus of elasticity than the material forming the quarter panels 106.

The upper 100 of the article of footwear 10 may be further described as including heel side panels 110 extending through the heel region 24 along the lateral and medial sides 16, 18 of the ankle opening 104. A heel counter 112 wraps around the posterior end 14 of the upper 100 and connects the heel side panels 110. Uppermost edges of the throat 108, the heel side panels 110, and the heel counter 112 cooperate to form a collar 114, which defines the ankle opening 104 of the interior void 102.

The upper 100 may be formed from one or more materials that are stitched or adhesively bonded together to define the interior void 102. Suitable materials of the upper 100 may include, but are not limited to, textiles, foam, leather, and synthetic leather. The example upper 100 may be formed from a combination of one or more substantially inelastic or non-stretchable materials and one or more substantially elastic or stretchable materials disposed in different regions of the upper 100 to facilitate movement of the article of footwear 10 between the tightened state and the loosened state. The one or more elastic materials may include any combination of one or more elastic fabrics such as, without limitation, spandex, elastane, rubber, or neoprene. The one or more inelastic materials may include any combination of one or more of thermoplastic polyurethanes, nylon, leather, vinyl, or another material/fabric that does not impart properties of elasticity.

Figure 4:
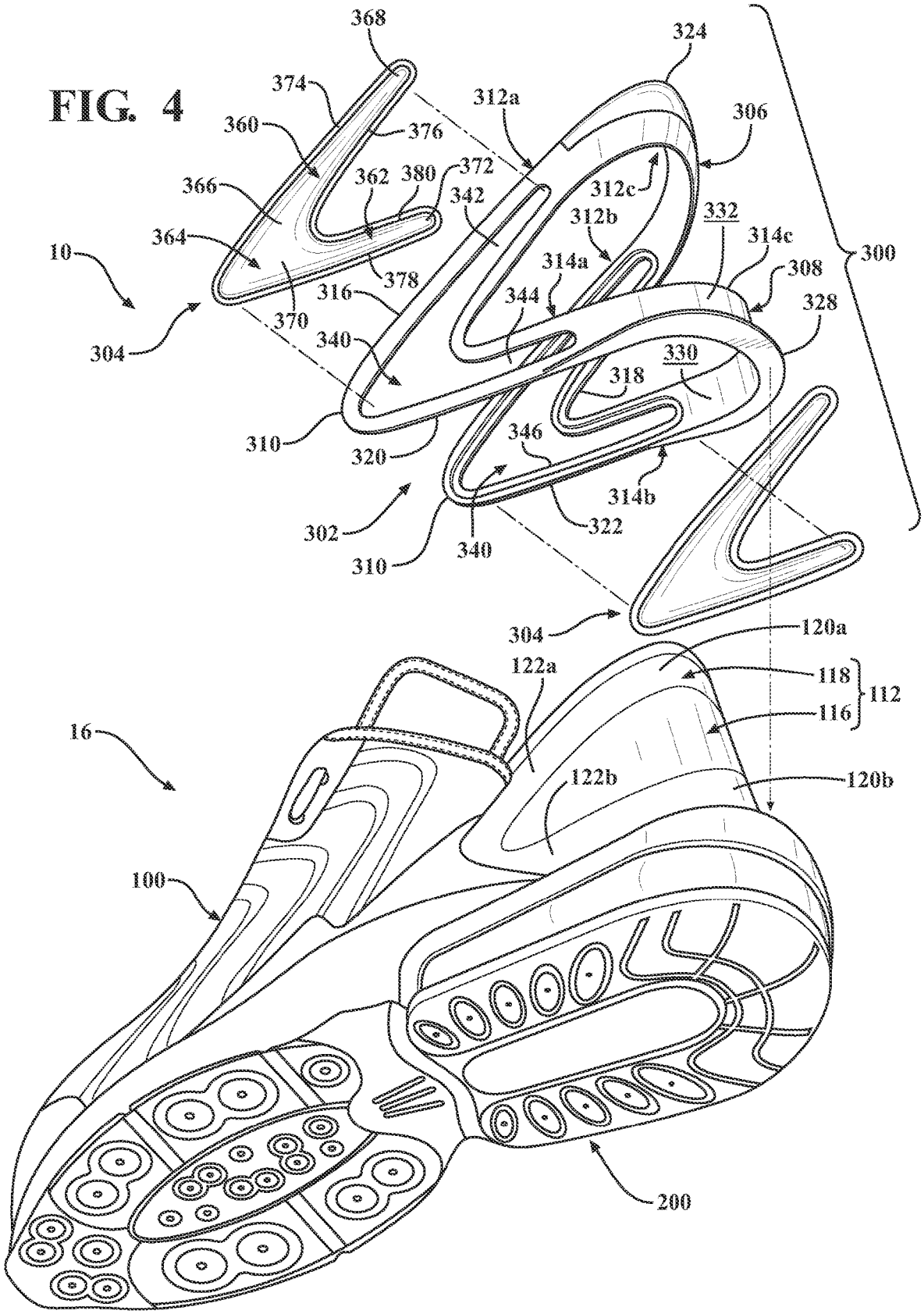
FIG. 4 is a medial perspective exploded view of the article of footwear of FIG. 1.
Figure 7:
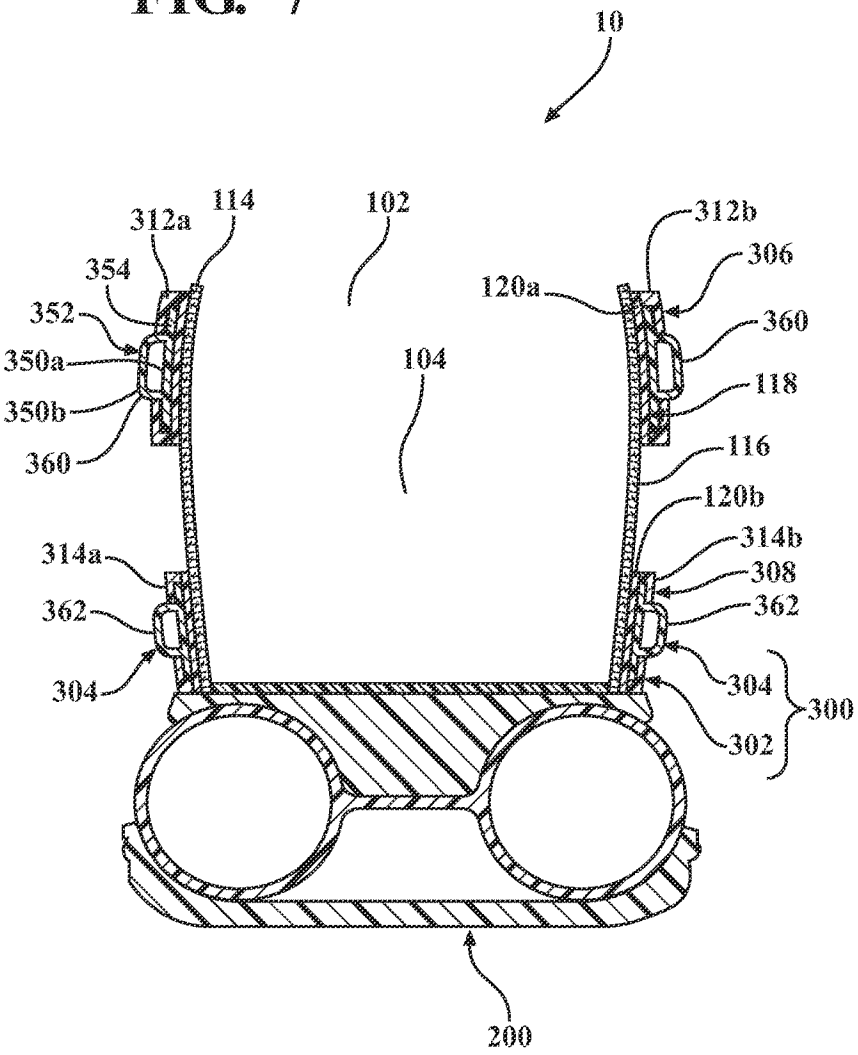
FIG. 7 is a cross-sectional view of the article of footwear of FIG. 1, taken along Line 7-7 in FIG. 2.
Figure 6:
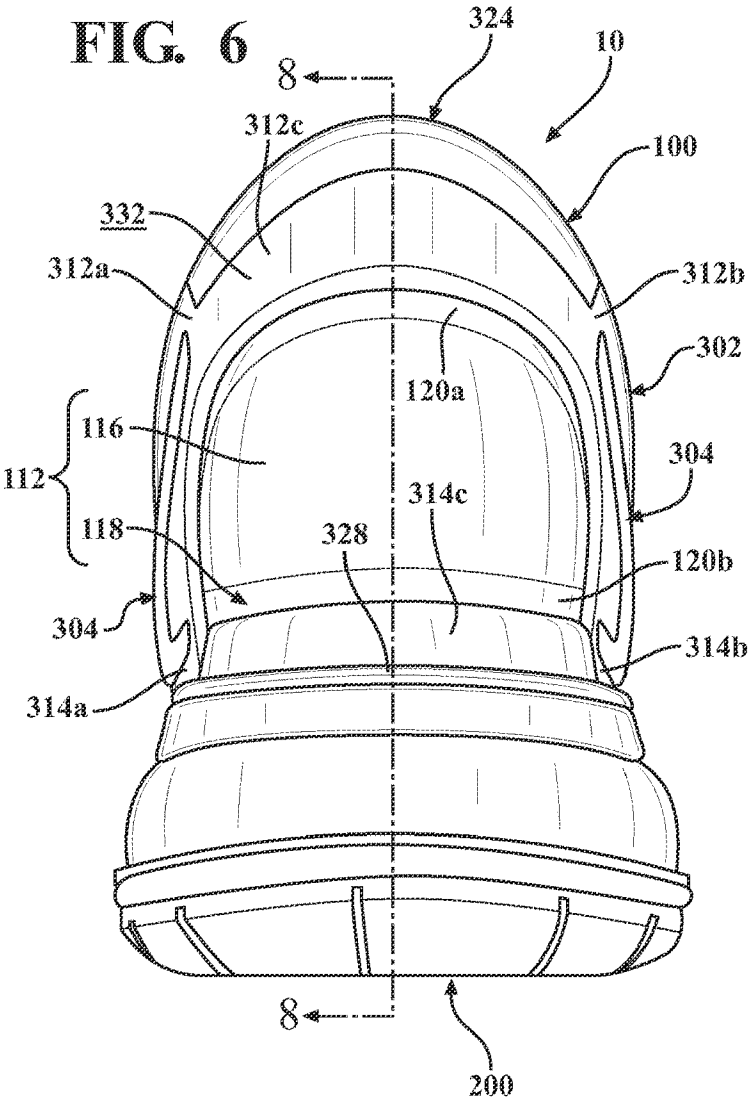
FIG. 6 is a posterior view of the article of footwear of FIG. 1.

As best shown in FIGS. 4 and 7, the heel counter 112 includes a flexible liner 116 including a first material and a reinforcement 118 attached to the liner 116 and including a second material. As shown, the reinforcement 118 is formed as one or more reinforcing bands 120*a*, 120*b* extending along an outer periphery of the heel counter 112. In one example, the reinforcement 118 includes an upper first band 120*a* extending along the collar 114 of the heel counter 112 from a first end 122*a* on the medial side 16 to a second end 124*a* on the lateral side 18. The reinforcement 118 may also include a lower second band 120*b* extending around the heel counter 112 adjacent to the sole structure 200. Here, the second band 120*b* extends from a first end 122*b* attached to the first end 122*a* of the first band 120*a* on the medial side 16 to a second end 124*b* attached to the second end 124*a* of the first band 120*a* on the lateral side 18. Each of the first band 120*a* and the second band 120*b* may include a constant width extending from the first end 122*a*, 122*b* to the second end 124*a*, 124*b*.

The first band 120*a* and the second band 120*b* are separated from each other between the first ends 122*a*, 122*b* and the second ends 124*a*, 124*b* to expose the liner 116 between the bands 120*a*, 120*b* and around the posterior end 14. In other words, intermediate portions of the upper first band 120*a* and the lower second band 120*b* are connected to each other by the liner 116 between the first ends 122*a*, 122*b* and the second ends 124*a*, 124*b*. In the illustrated example, the upper first band 120*a* diverges from the lower second band 120*b* along a direction from each end 122*a*, 124*a* towards the posterior end 14, such that the intermediate portion of the upper first band 120*a* is spaced apart from the lower second band 120*b* by a greater distance than portions of the upper band 120*a* located closer to the ends 122*a*, 124*a*.

As provided above, the liner 116 includes a first material having a relatively high pliability while the reinforcement 118 is configured to provide increased stiffness around the outer periphery of the heel counter 112. Furthermore, the reinforcement 118 is configured to provide an attachment interface for securing the support 300 along the heel counter 112 of the upper 100. In some examples, the liner 116 and the reinforcement 118 include different materials. For example, the liner 116 may include a supple synthetic leather material while the reinforcement 118 includes a no-sew thermoplastic polyurethane film attached to the liner 116.

Figure 8:
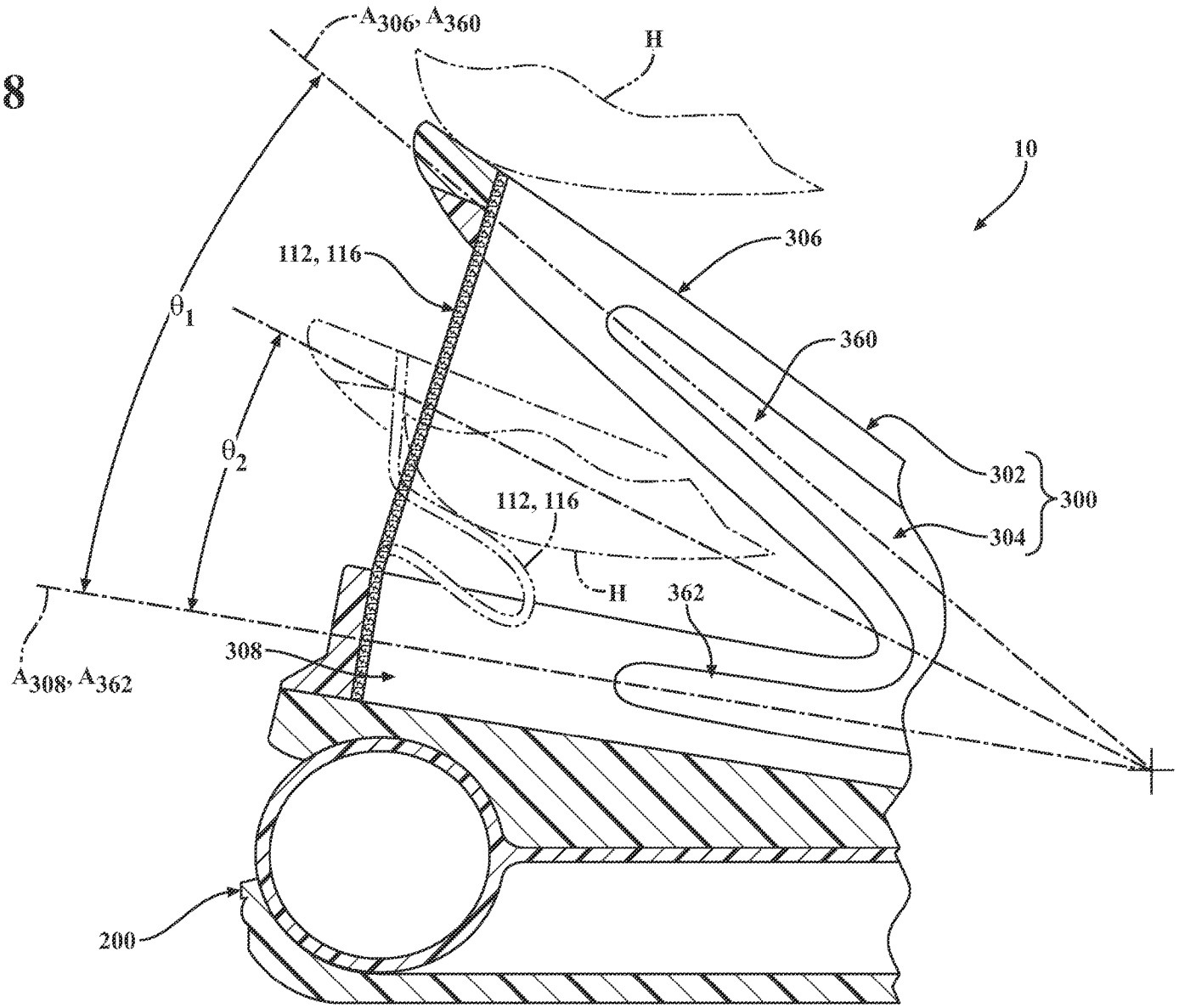
FIG. 8 is a cross-sectional fragmentary view of the article of footwear of FIG. 1, taken along Line 8-8 of FIG. 6 and showing a heel structure of the article of footwear in a first state and a second state.

The liner 116 and the reinforcement 118 cooperate to provide the heel counter 112 with a collapsible structure surrounding the posterior end 14 of the interior void 102. Thus, as shown in FIG. 8 and discussed in greater detail below, when a foot is inserted into the interior void 102 of the upper 100, the heel counter 112 may collapse around the posterior end 14 of the interior void 102 such that the ankle opening 104 is temporarily deformed to receive the foot. Particularly, the upper band 120*a* of the reinforcement 118 extending along the collar 114 can move towards the lower band 120*b* extending along the sole structure 200 by collapsing the material of the liner 116. Thus, the heel counter 112 is operable between an erect state (solid line in FIG. 8) and a collapsed state (dashed line in FIG. 8).

The article of footwear 10 includes the support 300 extending around the heel counter 112 from the medial side 16 to the lateral side 18. Generally, the support 300 is attached to the heel counter 112 and is configured to bias the heel counter 112 into the erect state. As described below, the support 300 includes a frame 302 having a first portion attached to the first band 120*a* of the reinforcement 118 and a second portion attached to the second band 120*b* of the reinforcement 118. A bladder 304 is coupled to the first and second portions of the frame 302 to bias the first and second portions of the frame 302 apart from each other to return the heel counter 112 to the erect state after the heel counter 112 is collapsed by a heel H of a foot.

The frame 302 includes an upper rail 306 extending along the heel counter 112 adjacent to the collar 114 and a lower rail 308 extending along the heel counter 112 between the upper rail 306 and the sole structure 200. In the illustrated example, the upper rail 306 is attached to the heel counter 112 along the upper band 120*a* of the reinforcement 118 and the lower rail 308 is attached to the heel counter 112 along the lower band 120*b* of the reinforcement 118. Thus, the lower rail 308 extends along the sole structure 200. Optionally, the frame 302 may include a pair of articulable joints 310 connecting the upper rail 306 to the lower rail 308 on opposite sides of the heel counter 112.

Figure 5:
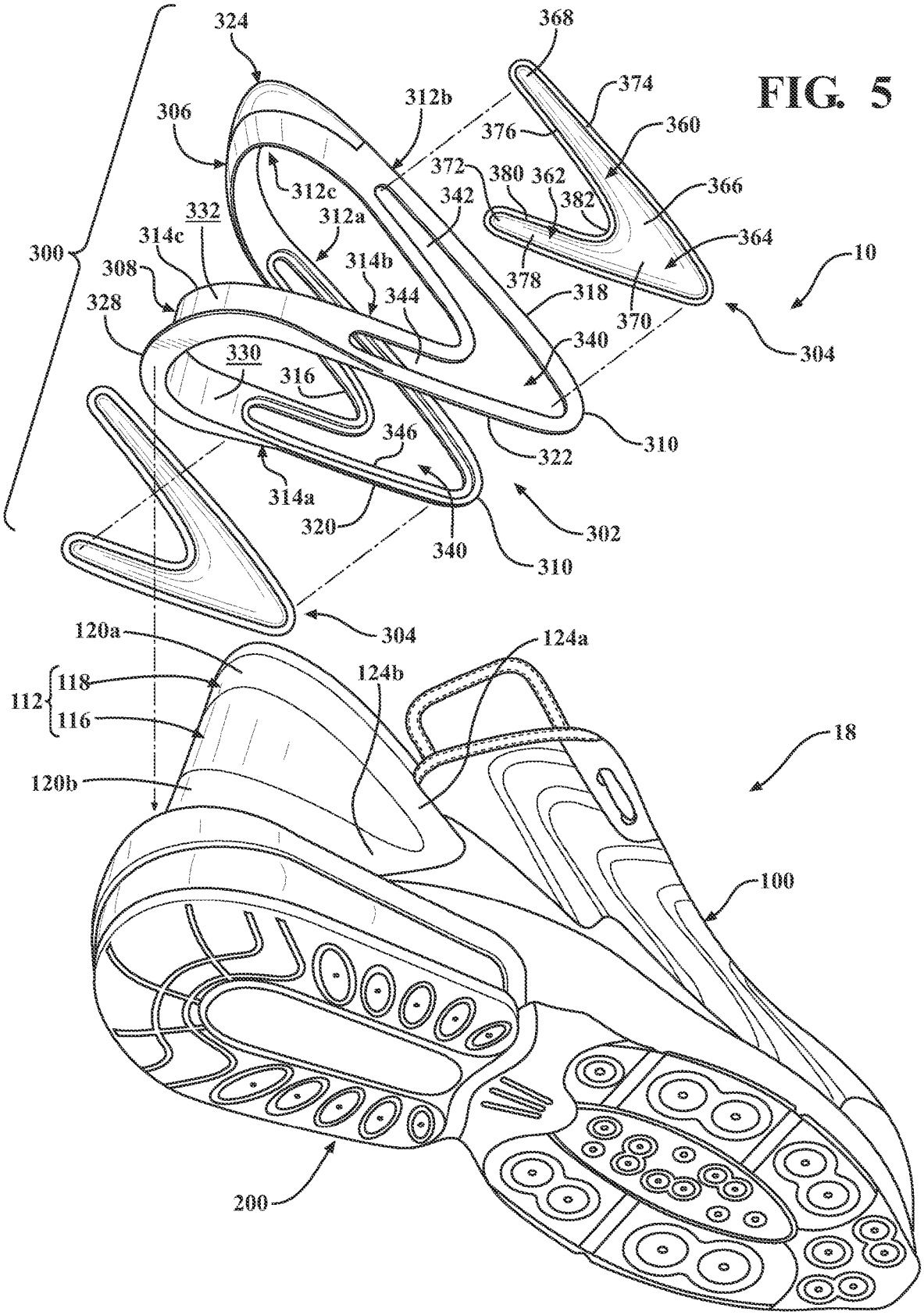
FIG. 5 is a lateral perspective exploded view of the article of footwear of FIG. 1.

With reference to FIGS. 4 and 5, the upper rail 306 may be described as including an upper-medial first segment 312*a* extending along the medial side 16 of the heel counter 112 adjacent to the collar 114 and an upper-lateral second segment 312*b* extending along the lateral side 18 of the heel counter 112 adjacent to the collar 114. The upper-medial segment 312*a* and the upper-lateral segment 312*b* may be collectively referred to as upper-side segments 312*a*, 312*b*. Optionally, the upper rail 306 may also include an upper-posterior third segment 312*c* extending around the posterior end 14 of the heel counter 112 and connecting the upper-medial segment 312*a* to the upper-lateral segment 312*b* such that the upper rail 306 extends continuously around the heel counter 112 from the medial side 16 to the lateral side 18. Thus, while the illustrated example of the frame 302 shows the upper rail 306 as being a continuous element, in some examples, the upper-posterior segment 312*c* may be omitted such that the upper rail 306 includes the upper-medial segment 312*a* and the upper-lateral segment 312*b*.

The lower rail 308 may also be described as including a lower-medial first segment 314*a* extending along the medial side 16 of the heel counter 112 adjacent to the sole structure 200 and a lower-lateral second segment 314*b* extending along the lateral side 18 of the heel counter 112 adjacent to the sole structure 200. The lower-medial segment 314*a* and the lower-lateral segment 314*b* may be collectively referred to as lower-side segments 314*a*, 314*b*. Optionally, the lower rail 308 may also include a lower-posterior third segment 314*c* extending around the posterior end 14 of the heel counter 112 and connecting the lower-medial segment 314*a* to the lower-lateral segment 314*b* such that the lower rail 308 extends continuously around the heel counter 112 from the medial side 16 to the lateral side. Thus, while the illustrated example of the frame 302 shows the lower rail 308 as being a continuous element, in some examples, the lower-posterior segment 314*c* may be omitted such that the lower rail 308 includes the lower-medial segment 314*a* and the lower-lateral segment 314*b*.

As set forth above, the illustrated example of the frame 302 includes each of the upper rail 306 and the lower rail 308 extending continuously around the heel counter 112. Particularly, the upper rail 306 extends around the heel counter 112 from a first end 316 on the medial side 16 to a second end 318 on the lateral side 18. Likewise, the lower rail 308 extends around the heel counter 112 from a first end 320 on the medial side 16 to a second end 322 on the lateral side 18. The upper rail 306 may have a variable width W306 (FIG. 9) that tapers along a lengthwise direction from each end 316, 318 towards the upper-posterior segment 312*c*. Thus, the width W306 of the upper rail 306 may be less along the upper-posterior segment 312*c* than along the upper-medial segment 312*a* and the upper-lateral segment 312*b*. Conversely, the lower rail 308 has a constant width W308 (FIG. 9) extending along the lengthwise direction from the first end 320 to the second end 322. Thus, the upper rail 306 is configured to flex along the lengthwise direction, particularly along the posterior end 14 of the heel counter 112, while the lower rail 308 is configured to provide a structural interface against the sole structure 200.

As discussed above, the first end 316 of the upper rail 306 may be coupled to the first end 320 of the lower rail 308 by a first one of the joints 310 on the medial side 16 and the second end 318 of the upper rail 306 may be coupled to the second end 322 of the lower rail 308 by a second one of the joints 310 on the lateral side 18. In the illustrated example, each of the joints 310 are integrally formed with the upper rail 306 and the lower rail 308. Thus, the joints 310 act as living hinges connecting the upper rail 306 to the lower rail 308 to allow the upper rail 306 to articulate relative to the lower rail 308.

Figure 9:
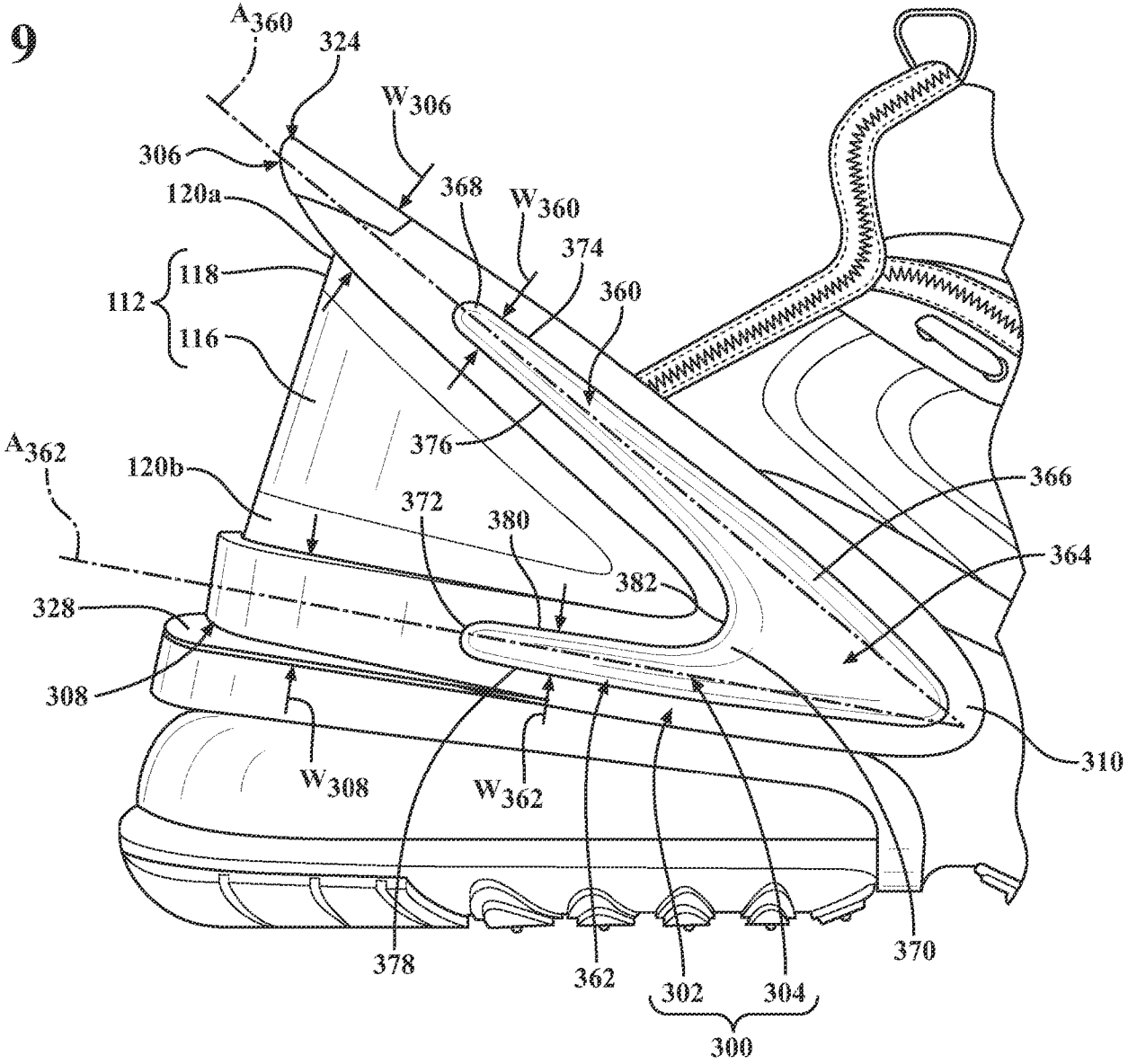
FIG. 9 is a medial side fragmentary view of the heel structure of the article of footwear of FIG. 1.

As shown, the upper rail 306 is oriented at an oblique angle relative to the lower rail 308 such that the upper rail 306 extends away from the lower rail 308 along a direction from each of the joints 310 to the posterior end 14. Here, the upper rail 306 is spaced apart or separated from the lower rail 308 between the joints 310 such that the liner 116 of the heel counter 112 is exposed between the upper rail 306 and the lower rail 308. Accordingly, the liner 116 of the heel counter 112 is configured to flex and deform between the rails 306, 308 when the frame 302 is collapsed. As shown in FIGS. 8 and 9, the frame 302 may be compressed such that the upper rail 306 flexes about each joint 310 from a first angle θ1 relative to the lower rail 308 when the heel counter 112 is in the erect state to a second angle θ2 when the heel counter 112 is in the collapsed state. As the frame 302 is compressed, the interior portion of the liner 116 surrounded by the frame 302 may fold or collapse to accommodate the transition between the erect state and the collapsed state.

The frame 302 may include one or more optional features to facilitate easier insertion of the foot into the interior void 102. For example, the upper rail 306 may include a ramp element 324 formed of a different material than the upper rail 306 and configured to facilitate sliding of the heel H of a foot into the ankle opening 104. Here, the ramp element 324 includes a material having a higher rigidity and/or a lower coefficient of friction than the material forming the upper rail 306. The ramp element 324 is attached along a top side of the upper rail 306 and may include a plurality of elongate guide grooves 326 extending radially outwardly from the ankle opening 104 along the top side of the ramp element 324. Thus, the guide grooves 326 are configured to guide the heel H into the ankle opening 104 and to allow the upper rail 306 to slide along the heel H and Achilles of the foot when the upper rail 306 moves to the erect state (01).

Optionally, the lower rail 308 of the frame 302 may include a peripheral flange 328 extending along the lower-posterior segment 314*c*. The peripheral flange 328 extends radially-outwardly from a bottom edge of the lower rail 308 and provides an attachment interface between the lower rail 308 and the sole structure 200. When included, the peripheral flange 328 stabilizes the lower rail 308 on the sole structure 200 to minimize deformation (i.e., twisting, bending, stretching, etc.) of the lower rail 308 when the frame 302 is compressed into the collapsed state (02).

The upper rail 306, lower rail 308, and joints 310 cooperate to define an interior surface 330 of the frame 302 that faces the heel counter 112 and an exterior surface 332 of the frame 302 that is formed on an opposite side from the interior surface 330 and faces away from the heel counter 112. Thus, a distance from the inner surface 330 to the outer surface 332 defines a thickness of the frame 302. The interior surface 330 of the frame 302 is attached to the heel counter 112 along the reinforcement 118.

Optionally, the frame 302 may include pair of receptacles 340 formed at least partially through the thickness of the frame 302 and configured to receive at least a portion of the bladder 304 therein for coupling the bladder 304 to the frame 302. In the illustrated example, the receptacle 340 extends through the entire thickness of the frame 302 such that a first portion of the bladder 304 is exposed to the heel counter 112 along the interior surface 330 of the frame 302 and a second portion of the bladder 304 is exposed along the exterior surface 332 of the frame 302. Here, the bladder 304 may be flush with the interior surface 330 of the frame 302 against the upper 100 and protrude from the exterior surface 332 of the frame 302.

The receptacles 340 include a first receptacle 340 formed in the medial side 16 of the frame 302 and a second receptacle 340 formed in the lateral side 18 of the frame 302. Each receptacle 340 includes a peripheral profile corresponding to a shape of the bladder 304. Accordingly, the shape or profile of the receptacle 340 may be described as including all of the features discussed below with respect to the bladder 304. For example, each receptacle 340 includes an upper leg 342 extending from the joint 310 along one of the upper-side segments 312*a*, 312*b* and a lower leg 344 extending from the respective joint 310 along a corresponding one of the lower-side segments 314*a*, 314*b*.

As discussed in greater detail below with respect to the bladder 304, the outer periphery of each receptacle 340 may include a stepped configured to capture a peripheral portion of the bladder 304 between the frame 302 and the heel counter 112. Particularly, the receptacle 340 includes a groove 346 formed in the interior surface 330 around the outer periphery of the receptacle 340. Here, the groove 346 receives a peripheral portion (e.g., a flange 354) of the bladder 304 such that the peripheral portion of the bladder 304 is received between the frame 302 and the upper 100 and sits flush with the interior surface 330 of the frame 302.

The frame 302 includes one or more materials selected to provide the ability to elastically deform by elastic bending and store potential energy, such as elastic energy, that returns the device 10 to the erect configuration when unloaded (i.e., not compressed by the heel). Example materials include plastics (such as thermoplastics), composites, and nylon. Another example material is a polyether block amide such as PEBAX® available from Arkema, Inc. in King of Prussia, Pa. USA. Another example material is a fiberglass reinforced polyamide. An example fiberglass reinforced polyamide is RISLAN® BZM 7 0 TL available from Arkema, Inc. in King of Prussia, Pa. USA. Such a fiberglass reinforced polyamide may have a density of 1.07 grams per cubic centimeter under ISO 1183 test method, an instantaneous hardness of 75 on a Shore D scale under ISO 868 test method, a tensile modulus of 1800 MPa under ISO 527 test method (with samples conditioned 15 days at 23 degrees Celsius with 50% relative humidity), and a flexural modulus of 1500 MPa under ISO 178 test method (with samples conditioned 15 days at 23 degrees Celsius with 50% relative humidity).

In the illustrated example, the frame 302 is formed as a monolithic structure such that the upper rail 306, the lower rail 308, and the joints 310 are integrally formed of the same material. However, in some examples, the upper rail 306, the lower rail 308, and the joints 310 may be formed independently from each other and joined together. Here, the upper rail 306, the lower rail 308, and the joints 310 may include different materials. For example, the upper rail 306 and/or the lower rail 308 may include materials having a greater hardness or rigidity than the materials of the joints 310 such that the rails 306, 308 provide strength and the joints provide resiliency.

With reference to FIGS. 4, 5 and 7, the bladder 304 of the support 300 includes an opposing pair of barrier layers 350*a*, 350*b*, which can be joined to each other at discrete locations to define an elongate fluid-filled chamber 352 and a peripheral seam 354. In the example shown, the barrier layers 350*a*, 350*b* include a first, inner barrier layer 350*a* configured to face the upper 100 and a second, outer barrier layer 350*b* configured to protrude through the frame 302 of the support 300. Here, the inner barrier layer 350*a* may be substantially planar and defines a first side of the bladder 304 facing the upper 100 while the outer barrier layer 350*b* defines a portion of the fluid-filled chamber 352 that is received by the receptacle 340 and protrudes from the exterior surface 332 of the frame 302.

As used herein, the term "barrier layer" (e.g., barrier layers 350*a*, 350*b*) encompasses both monolayer and multilayer films. The barrier layers 350*a*, 350*b* can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

The fluid-filled chamber 352 can be produced from barrier layers 350*a*, 350*b* using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 350*a*, 350*b* can be produced by co-extrusion followed by vacuum thermoforming to produce an inflatable chamber 352, which can optionally include one or more valves (e.g., one way valves) that allows the chamber 352 to be filled with the fluid (e.g., gas).

The chamber 352 can be provided in a fluid-filled (e.g., as provided in footwear 10) or in an unfilled state. The chamber 352 can be filled to include any suitable fluid, such as a gas or liquid. In an aspect, the gas can include air, nitrogen ($N_2$), or any other suitable gas. In other aspects, the chamber 352 can alternatively include other media, such as pellets, beads, ground recycled material, and the like (e.g., foamed beads and/or rubber beads). The fluid provided to the chamber 352 can result in the chamber 352 being pressurized. Alternatively, the fluid provided to the chamber 352 can be at atmospheric pressure such that the chamber 352 is not pressurized but, rather, simply contains a volume of fluid at atmospheric pressure.

The barrier layers 350*a*, 350*b* cooperate to define a geometry (e.g., thicknesses, width, and lengths) of the fluid-filled chamber 352. For example, the peripheral seam 354 may cooperate to bound and extend around the fluid-filled chamber 352 to seal the fluid (e.g., air) within the fluid-filled chamber 352. Thus, the fluid-filled chamber 352 is associated with an area of the bladder 304 where interior surfaces of the barrier layers 350*a*, 350*b* are not joined together and, thus, are separated from one another.

Each chamber 352 includes an upper first leg 360 configured to be coupled to an upper-side segment 312*a*, 312*b* of the frame 302 and a lower second leg 362 configured to be coupled to a corresponding lower-side segment 314*a*, 314*b* of the frame 302. As shown, each of the first leg 360 and the second leg 362 extend from and are fluidly connected by a common junction 364 at a first end of the bladder 304. The junction 364 is configured to couple one of the joints 310 of the frame 302 associated with a respective pair of side segments 312*a*, 312*b*, 314*a*, 314*b*. Thus, when the support 300 is assembled, a first leg 360, a second leg, 362, and a junction 364 of the bladder 304 will respectively couple to the upper-side segment 312*a*, 312*b*, the lower-side segment 314*a*, 314*b*, and the joint 310 on one side 16, 18 of the upper 100.

Referring to FIG. 9, the first leg 360 of each bladder 304 extends along a longitudinal axis A360 from a proximal first end 366 at the junction 364 to a terminal second end 368. Likewise, the second leg 362 extends along a longitudinal axis A362 from a proximal first end 370 at the junction 364 to a terminal second end 372. The first leg 360 of each bladder 304 may have a greater length (i.e., extends farther from the junction 364) than the second leg 362. Thus, the longer first legs 360 of the bladder 304 cooperate to provide a biasing force along a greater portion of the upper rail 306 of the frame 302 while the shorter second legs 360 function to anchor the bladder 304 within the fixed lower rail 308.

In the illustrated example, the first leg 360 of the chamber 352 includes an upper-outer edge 374 and an upper-inner edge 376 formed on an opposite side of the first leg 360 than the upper-outer edge 374. Similarly, the second leg 362 includes a lower-outer edge 378 extending from the first end 370 to the second end 372 and a lower-inner edge 380 formed on an opposite side of the second leg 362 than the lower-outer edge 378. A distance from the outer edge 374, 378 to the inner edge 376, 380 of each leg 360, 362 defines a respective width W360, W362 of the leg 360, 362. In the illustrated example, the width W360 of the first leg 360 tapers along the direction from the junction 364 to the terminal end 368 while the width W362 of the second leg 362 is substantially constant between the junction 364 and the terminal end 372.

As shown, the longitudinal axes A360, A362 of the first leg 360 and the second leg 362 diverge from each other along a direction from the junction 364 to the respective terminal ends 368, 372. In other words, the first leg 360 and the second leg 362 converge with each other at the junction 364 such that the respective outer edges 374, 378 intersect each other to form an anterior end of the junction and the inner edges 376, 380 intersect each other to form a hinge region 382 between the legs 360, 362. Optionally, a radius connecting the inner edges 376, 380 is greater at the hinge region 382 than a radius connecting the outer edges 374, 378. The larger radius of the hinge region 382 allows the first leg 360 to flex relative to the second leg 362 at the junction 364 without fully collapsing (i.e., folding or creasing) the chamber 352, such that the chamber 352 maintains a biasing force for returning the support 300 to the erect state.

In some examples, the bladder 304 may be coupled to the frame 302 by attaching the inner barrier layer 350*a* or the outer barrier layer 350*b* to either one of the interior surface 330 or the exterior surface 332 of the frame 302. However, in the illustrated example, the bladder 304 is at least partially received within the frame 302. Particularly, the bladder 304 is received within the receptacle 340 such that the legs 360, 362 of each one of the bladders 304 are received within corresponding legs 342, 344 of one the receptacles 340. For instance, the legs 360, 362 of a first bladder 304 are received within the legs 342, 344 of a first receptacle 340 on the medial side 16 and the legs 360, 362 of a second bladder 304 are received within the legs 342, 344 of a second receptacle 340 on the lateral side 18.

In the illustrated example, the peripheral seam 354 includes a flange 354 extending outwardly from the outer periphery of the fluid-filled chamber 352. As set forth above, the inner barrier layer 350*a* is substantially planar such that the flange 354 is flush with the chamber 352 on a first side of the bladder 304 facing inwardly towards the heel counter 112. Here, the flange 354 is received within the groove 346 that surrounds the outer periphery of the receptacle 340 such that a lap joint is formed between the flange 354 and the frame 302 around the periphery of the receptacle 340. In the illustrated example, the flange 354 surrounds the entire chamber 352. However, in other examples, the flange 354 and groove 346 may be intermittent and only surround portions of the chamber 352.

The outer barrier layer 350*b* of the bladder 304 defines a thickness of the chamber 352 that extends through the receptacle 340 from the groove 346. Optionally, the thickness of the chamber 352 is greater than a thickness of the frame 302 from the groove 346 to the exterior surface 332 such that the outer barrier layer 350*b* protrudes from the exterior surface 332. Thus, the bladder 304 may provide both a biasing force and a cushioning function to the heel region of the upper.

The sole structure 200 of the article of footwear 10 may be configured as a monolithic sole structure or as a composite sole structure including a plurality of components joined together. For example, the sole structure 200 of the present example includes a midsole having one or more foam cushioning elements extending through the forefoot region 20 and the mid-foot region 22 and a fluid-filled chamber extending around the heel region 24. An outsole of the sole structure may be attached to one or more areas of the midsole to provide the sole structure 200 with an abrasion resistant ground-engaging surface.

In use, the article of footwear 10 is configured to be easily donned and doffed by a wearer by allowing the upper 100 to be selectively collapsed around the ankle opening 104 in the heel region 24. Incorporating the bladder 304 within the frame 302 of the support 300 provides a simplified biasing means between the upper and lower rails 306, 308 of the frame 302 while allowing the pliable liner 116 of the heel counter 112 to freely collapse when the heel counter 112 is compressed by a foot.

The following Clauses provide an exemplary configuration for an article of footwear described above.

Clause 1. An article of footwear comprising a sole structure, an upper attached to the sole structure and including an opening providing access to an interior void of the upper, a support attached to the upper at a posterior end of the upper and including a first rail disposed adjacent to the opening of the upper and a second rail extending between the first rail and the sole structure and continuously along the posterior end from a medial side of the upper to a lateral side of the upper, and a bladder disposed between the first rail and the second rail.

Clause 2. The article of footwear of Clause 1, wherein the bladder includes a first leg extending along the first rail to a first distal end and a second leg extending along the second rail to a second distal end.

Clause 3. The article of footwear of Clause 2, wherein the first leg of the bladder and the second leg of the bladder are connected at a junction disposed proximate to the sole structure.

Clause 4. The article of footwear of any of the preceding Clauses, wherein the bladder is disposed within the support.

Clause 5. The article of footwear of any of the preceding Clauses, wherein the support includes a first end disposed on one of a lateral side of the upper and a medial side of the upper, the first rail and the second rail connected to each other at the first end.

Clause 6. The article of footwear of any of the preceding Clauses, wherein the bladder extends through a thickness of the support.

Clause 7. The article of footwear of any of the preceding Clauses, wherein a first portion of the bladder is disposed between the support and the interior void and a second portion extends through the support.

Clause 8. The article of footwear of Clause 7, wherein the first portion is a flange.

Clause 9. The article of footwear of Clause 8, wherein the second portion is a fluid-filled chamber.

Clause 10. The article of footwear of any of the preceding Clauses, wherein (i) the first rail is separated from the second rail by a gap and (ii) a flexible first material is exposed through the support within the gap between the first rail and the second rail.

Clause 11. The article of footwear of any of the preceding Clauses, wherein the first rail is biased in an upward position in a relaxed state and is elastically deformable to a lowered position in repose to an applied downward force.

Clause 12. The article of footwear of Clause 11, wherein the first rail is disposed closer to the second rail in the lowered position.

Clause 13. An article of footwear comprising an upper including an opening providing access to an interior void of the upper and a support including a bladder having (i) a first leg extending along one of a medial side of the upper and a lateral side of the upper to a first distal end and (ii) a second leg extending from the first leg along the one of the medial side of the upper and the lateral side of the upper between the first leg and the opening to a second distal end.

Clause 14. The article of footwear of Clause 13, wherein the support includes a frame attached to the upper, the bladder being coupled to the frame.

Clause 15. The article of footwear of Clause 14, wherein a first portion of the bladder is disposed within the frame.

Clause 16. The article of footwear of Clause 15, wherein a second portion of the bladder is disposed between the frame and the interior void.

Clause 17. The article of footwear of Clause 16, wherein the first portion is a fluid-filled chamber and the second portion is a peripheral flange extending from the fluid-filled chamber.

Clause 18. The article of footwear of Clause 14, wherein the frame includes a first rail coupled to the first leg of the bladder and a second rail coupled to the second leg of the bladder.

Clause 19. The article of footwear of Clause 18, wherein the first rail extends around the opening of the upper.

Clause 20. The article of footwear of any of the preceding Clauses, wherein a width of the first leg tapers along a direction towards the first distal end.

Clause 21. The article of footwear of any of the preceding Clauses, wherein the first leg extends at an oblique angle from the second leg.

Clause 22. The article of footwear of any of the preceding Clauses, wherein the bladder is operable between an erect state where the first distal end is spaced apart from the second distal end by a first distance and a collapsed state where the first distal end is spaced apart from the second distal end by a second distance that is less than the first distance.

Clause 23. The article of footwear of any of the preceding Clauses, wherein the first leg is biased in an upward position in a relaxed state and is elastically deformable to a lowered position in repose to an applied downward force.

Clause 24. The article of footwear of Clause 23, wherein the first leg is disposed closer to the second leg in the lowered position.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. An article of footwear comprising:

a sole structure;

an upper attached to the sole structure and including an opening providing access to an interior void of the upper;

a support attached to the upper at a posterior end of the upper and including:

a first rail disposed adjacent to the opening of the upper and a second rail extending between the first rail and the sole structure and continuously along the posterior end from a medial side of the upper to a lateral side of the upper, a first receptacle extending through the support such that the first receptacle starts and terminates on the medial side of the upper, and a second receptacle extending through the support such that the second receptacle starts and terminates on the lateral side of the upper; and a bladder disposed in each of the first receptacle and the second receptacle between the first rail and the second rail and extending through the support.

2. The article of footwear of claim 1, wherein the bladder includes a first leg extending along the first rail to a first distal end and a second leg extending along the second rail to a second distal end.

3. The article of footwear of claim 2, wherein the first leg of the bladder and the second leg of the bladder are connected at a junction disposed proximate to the sole structure.

4. The article of footwear of claim 1, wherein the support includes a first end disposed on one of the lateral side of the upper and the medial side of the upper, the first rail and the second rail connected to each other at the first end.

5. The article of footwear of claim 1, wherein a first portion of the bladder is disposed between the support and the interior void and a second portion extends through the support.

6. The article of footwear of claim 5, wherein the first portion is a flange.

7. The article of footwear of claim 6, wherein the second portion is a fluid-filled chamber.

8. The article of footwear of claim 1, wherein (i) the first rail is separated from the second rail by a gap and (ii) a flexible first material is exposed through the support within the gap between the first rail and the second rail.

9. An article of footwear comprising:

an upper including an opening providing access to an interior void of the upper;

a support, including:

a first receptacle extending through the support such that the first receptacle starts and terminates on a medial side of the upper, and a second receptacle extending through the support such that the second receptacle starts and terminates on a lateral side of the upper; and a bladder arranged in the first receptacle and the second receptacle and extending through the support, the bladder having a first leg extending along one of the medial side of the upper and the lateral side of the upper to a first distal end and a second leg extending from the first leg along the one of the medial side of the upper and the lateral side of the upper between the first leg and the opening to a second distal end.

10. The article of footwear of claim 9, wherein the support includes a frame attached to the upper, the bladder being coupled to the frame.

11. The article of footwear of claim 10, wherein a first portion of the bladder is disposed within the frame.

12. The article of footwear of claim 11, wherein a second portion of the bladder is disposed between the frame and the interior void.

13. The article of footwear of claim 12, wherein the first portion is a fluid-filled chamber and the second portion is a peripheral flange extending from the fluid-filled chamber.

14. The article of footwear of claim 10, wherein the frame includes a first rail coupled to the first leg of the bladder and a second rail coupled to the second leg of the bladder.

15. The article of footwear of claim 14, wherein the first rail extends around the opening of the upper.

16. The article of footwear of claim 9, wherein a width of the first leg tapers along a direction towards the first distal end.

17. The article of footwear of claim 9, wherein the first leg extends at an oblique angle from the second leg.

18. The article of footwear of claim 9, wherein the bladder is operable between an erect state where the first distal end is spaced apart from the second distal end by a first distance and a collapsed state where the first distal end is spaced apart from the second distal end by a second distance that is less than the first distance.

* * * * *